US008424478B1

(12) United States Patent
VanDerryt

(10) Patent No.: US 8,424,478 B1
(45) Date of Patent: Apr. 23, 2013

(54) DEVICE FOR TEMPORARY REMEDIATION OF HOLES IN SHIP HULLS

(75) Inventor: Steven P. VanDerryt, Westampton, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 539 days.

(21) Appl. No.: 12/573,173

(22) Filed: Oct. 5, 2009

(51) Int. Cl.
*B63B 43/16* (2006.01)

(52) U.S. Cl.
USPC ..... 114/227; 114/228

(58) Field of Classification Search ..... 114/227–229; 29/402.14; 220/243, 244, 251
See application file for complete search history.

(56) References Cited

U.S. PATENT DOCUMENTS

| | | | | |
|---|---|---|---|---|
| 417,894 | A * | 12/1889 | Winchester | 114/227 |
| 533,280 | A * | 1/1895 | Douglas | 114/227 |
| 1,676,395 | A * | 7/1928 | Korner | 114/228 |
| 2,220,085 | A * | 11/1940 | Dirschel | 114/227 |
| 3,669,055 | A | 6/1972 | Buce | |
| 4,385,582 | A | 5/1983 | Fuerst | |
| 4,951,590 | A * | 8/1990 | Kassbaum | 114/227 |
| 4,953,491 | A | 9/1990 | Zaitoun | |
| 5,009,180 | A | 4/1991 | Holt | |
| 5,025,972 | A | 6/1991 | Finlan | |
| 5,036,786 | A | 8/1991 | Uri | |
| 5,143,012 | A | 9/1992 | Elkowitz | |
| 5,165,356 | A | 11/1992 | Williams | |
| 5,216,973 | A | 6/1993 | Gwinn | |
| 5,253,602 | A | 10/1993 | Moriarty | |
| 5,277,143 | A | 1/1994 | Frangulea | |
| 5,562,064 | A | 10/1996 | Cunningham et al. | |
| 7,451,717 | B1 | 11/2008 | Levine et al. | |

FOREIGN PATENT DOCUMENTS

| | | | |
|---|---|---|---|
| FR | 2259009 A | * | 9/1975 |
| GB | 2432562 A | * | 5/2007 |
| SU | 1110718 A | * | 8/1984 |

* cited by examiner

*Primary Examiner* — Ajay Vasudeva
(74) *Attorney, Agent, or Firm* — Howard IP Law Group, PC

(57) ABSTRACT

A device is disclosed for temporary plugging of holes in ship hulls. The device has a shaft with a spring-loaded rod disposed therein. At one end of the shaft is a cylinder housing a piston that is connected to the rod for movement within the cylinder. The cylinder has pivoting levers that are movable via the piston between a stowed position, in which the levers are parallel to the shaft, and a deployed position, in which the levers are perpendicular to the shaft. A seal is connected to the levers. A second cylinder is slidably disposed along the shaft, and has a plurality of guide arms connected thereto. In operation, the device is pressed into the hole so the levers and cylinder housing are outside the ship. The spring is activated causing the rod and piston to move, which deploys the levers and unfolds the seal. Inrushing water forces the levers and seal to engage the outside of the hull surrounding the opening, inhibiting further flooding. To secure the device, the second cylinder is pushed along the shaft until the guide arms engaging the inside of the hull surrounding the opening. The ratchet and pawl assembly prevents the second cylinder and guide arm from reversing their movement.

19 Claims, 9 Drawing Sheets

DEVICE FOR TEMPORARY REMEDIATION OF HOLES IN SHIP HULLS

FIELD OF THE INVENTION

The invention relates generally to systems for repairing breaches in ship hulls, and more particularly to a system for providing quick and effective temporary plugging of holes in ship hulls caused by damage from explosion, collisions or projectile impacts.

BACKGROUND OF THE INVENTION

When a ship has suffered a breach in its hull, the most urgent requirement is to stop or reduce the amount of inrushing water so the danger of immediate sinking can be prevented. A breach in a hull with a total area of 12 square inches, located 10 feet below the water line, allows water to enter the ship at a rate of nearly 9,000 gallons per minute (GPM). At such a rate most ships will quickly fill with water and sink.

Present techniques for plugging relatively small holes (i.e., up to six inches) require ship's personnel to pound precut pieces of wood into the hole. Of course, this procedure has a number of drawbacks. For example, if the compartment has already filled with a large amount of water such that the hole is underwater, it can be extremely difficult to swing a hammer to pound the wooden blocks into the hole. In addition, it is often difficult to keep the blocks in the hole where water is rushing in through the hole, since, apart from the wood swelling, there is nothing to hold the blocks in the hole. If the hole is part of a tear in the steel, fiberglass or wooden hull of a ship, pounding in a plug can make the tear larger. Further, as the wooden block swells it can force the tear apart and make it bigger.

If the total size of the hole can at least be reduced to an equivalent of 1 square inch at the same 10 feet depth, the amount of water entering the ship could be reduced to less than 64 GPM. A rate of 64 GPM flooding can be controlled using pumps. The extra time gained by this reduced influx of water can mean the difference between losing and saving the ship.

Since the water that will be flooding into the ship is under pressure it will wash away anything not properly supported or strong enough to withstand this pressure. Thus, any device used to stop the flooding must be quick and easy to use, and must be strong enough to survive the inrushing water.

The disclosed device can be ready to use as soon as its guide arms are opened and the device is pushed into the hole and the trigger is activated. The inrushing water helps open the device, and once the device is fully opened and covering the breach from outside the hull, the guide arms are ratcheted down toward the inside of the hull to hold the device against the hull.

SUMMARY OF THE INVENTION

A device is disclosed for enabling quick and efficient plugging of holes in ship hulls. The device has a quick activating self-unfolding mechanism that provides a temporary patch over holes in a ship's hull caused by an explosion, collision, or projectile impact. A folding arm device acts to block water from coming in through the breach in the hull. In addition, the device does not put additional pressure on a tear radiating out from the hole in the hull.

There is no system that will ever replace the resourcefulness, ingenuity and inventiveness of sailors when their ship is in danger. The disclosed device can permit a crew to quickly and efficiently control flooding from a breach in the hull.

A device is disclosed for inhibiting fluid flow through an opening. The device may include a shaft having first and second ends and a folding lever assembly disposed at the first end of the shaft portion. The folding lever assembly may have a refracted position and an extended position. The device may further include a sliding guide arm assembly associated with the shaft portion, the sliding guide arm assembly having a plurality of guide arms oriented non-parallel to the shaft portion. The device may also have a seal connected to the folding lever assembly such that when the folding lever assembly is configured from the retracted position to the extended position the seal is configured from a folded configuration to an unfolded configuration and the folding lever assembly is positionable opposite the plurality of guide arms to enable the device to engage a structure therebetween.

A device is disclosed for covering an opening in a structure. The device may comprise a shaft having first and second ends and a longitudinal axis. The device may also include a folding lever assembly disposed at the first end of the shaft portion, the folding lever assembly comprising a plurality of extendable arms. Each of the plurality of extendable arms may have an extended position and a folded position. A guide arm assembly may be provided having a collar and a plurality of guide arms disposed in non-parallel relation to the longitudinal axis of the shaft. The collar may be slidably associated with the shaft such that the guide arm assembly is movable between first and second positions along the shaft. The device may further have a seal connected to at least one of the plurality of extendable arms of the folding lever assembly so that when the folding lever assembly is in the retracted position, the seal is in a folded configuration, and when the folding lever assembly is in the extended position, the seal is in an unfolded configuration.

A method for securing a device within an opening in a plate member is also disclosed, comprising: providing a device having a shaft, a plurality of extendable arms disposed at a first end of the shaft, a plurality of guide arms are movable along the shaft, and a seal connected to at least one of the plurality of extendable arms; disposing the device within the opening such that the plurality of extendable arms are positioned on a first side of the opening and the plurality of guide arms are positioned on a second side of the opening; and moving the plurality of guide arms along the shaft to engage structure surrounding the opening to thereby sandwich the structure between the plurality of guide arms and the plurality of extendable arms, and to dispose the seal over the first side of the opening to inhibit fluid flow from the first side of the opening to the second side of the opening.

DESCRIPTION OF THE DRAWINGS

The details of the invention, both as to its structure and operation, may be obtained by a review of the accompanying drawings, in which like reference numerals refer to like parts, and in which.

DETAILED DESCRIPTION

Figure 1A:
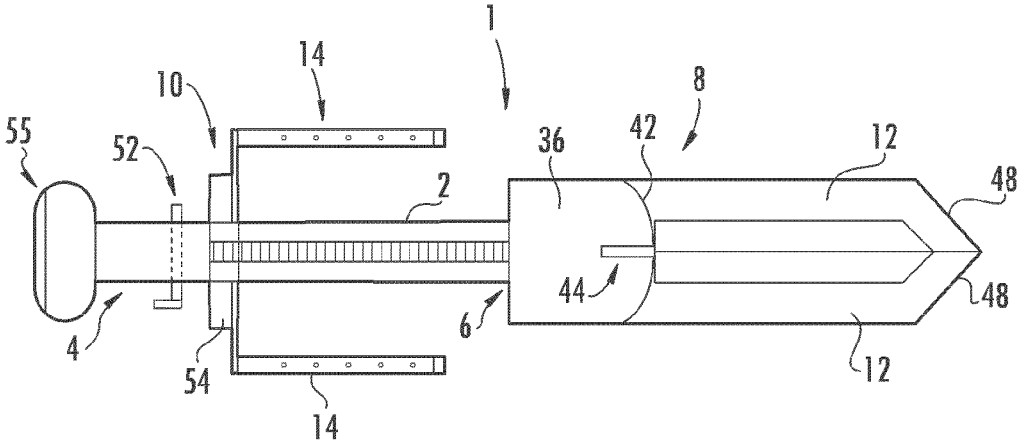
FIG. 1A is a side view of the disclosed device in the stowed position.

In the accompanying drawings, like items are indicated by like reference numerals. This description of the preferred embodiments is intended to be read in connection with the accompanying drawings, which are to be considered part of the entire written description of this invention. In the description, relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

Figure 1B:
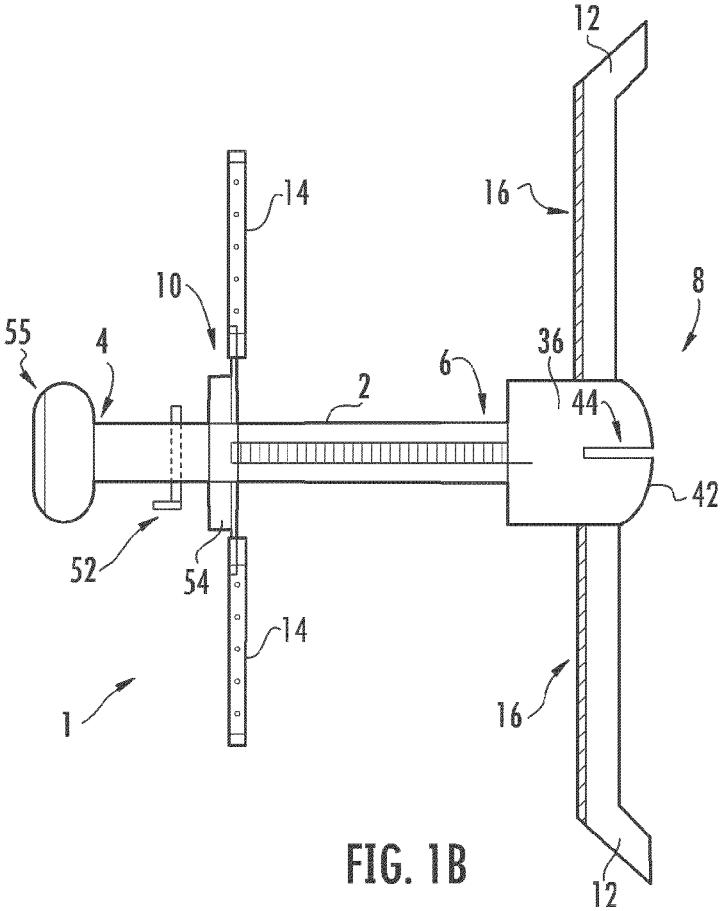
FIG. 1B is a side view of the disclosed device in the deployed position.

The disclosed device provides a quick and efficient way to temporarily plug holes in hulls of ships to minimize the ingress of flooding water and to enable the ship to return to port where permanent repairs can be undertaken. Referring generally to FIGS. 1A-7C, the device 1 comprises a shaft 2 having first and second ends 4, 6. A folding lever assembly 8 is attached to the second end 6 of the shaft, and a sliding guide arm assembly 10 is slidably positioned about the shaft 2 so that it can be moved along the shaft toward the folding lever assembly 8 during operation. The folding lever assembly 8 has a plurality of extendable levers 12 that are movable between a retracted position (FIG. 1A) and an extended position (FIG. 1B). The sliding guide arm assembly has a plurality of guide arms 14 that extend away from the shaft 2. A seal 16 is connected to the folding lever assembly 8 such that the seal is held in a folded condition when the folding lever assembly is in the retracted position. The seal 16 unfolds when the folding lever assembly 8 is in the extended position.

Figure 3A:
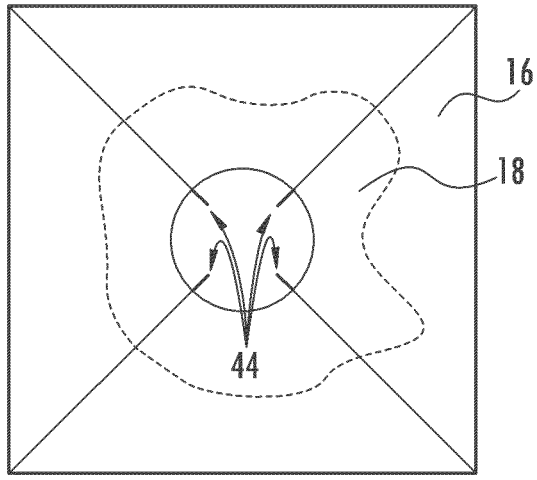
FIG. 3A is a plan view of the device of FIG. 1A in the deployed position.
Figure 3B:
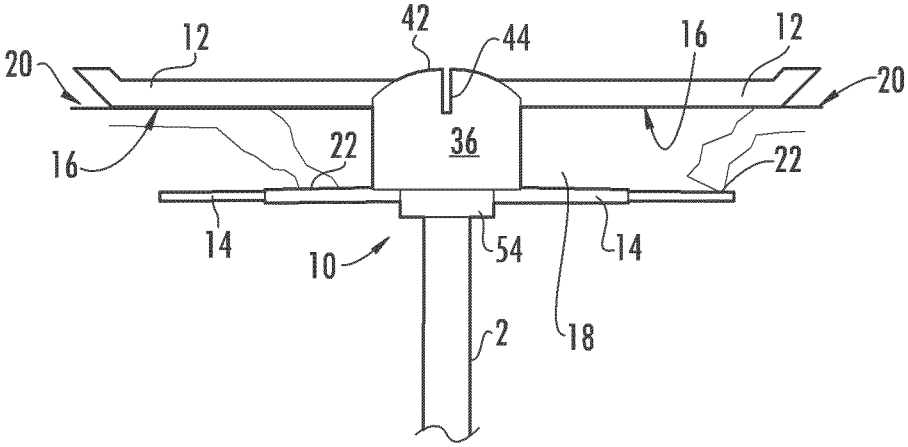
FIG. 3B is a side view of the device of FIG. 1A deployed in a hole in a ship's hull.

In operation, the folding lever assembly 8 is placed through a hole 18 in a ship's hull (see FIGS. 3A, 3B). The assembly 8 is initially configured in the retracted position (FIG. 1A), so that the extendable levers 12 can be easily passed through the hole 18. Once inserted, the device 1 is actuated so that the folding lever assembly 8 is configured in the extended position (FIG. 1B). In the extended position the plurality of extendable levers 12 extend away from the shaft 2, expanding the seal 16. The seal 16 and levers 12 are forced by the pressure of inrushing water to engage the outside surface 20 of the hull adjacent the hole 18 (FIG. 3A). In this position, the seal 16, supported by the levers 12, blocks further inflow of water through the hole 18. To lock the device 1 in place, the sliding guide arm assembly 10 is moved along the shaft 2 toward the folding lever assembly 8 until the guide arms 14 engage the inside surface 22 of the hull adjacent the opening 18. A ratchet and pawl arrangement (see FIGS. 6A, 6B) prevents the sliding guide arm assembly 10 from backing up on the shaft 2, thus sandwiching the hull (and opening) between the folding lever assembly 8 and the sliding guide arm assembly 10. The device 1 remains in this locked position until more permanent repair can be made to the hull.

As noted, the device 1 is configured to sandwich a portion of a ship's hull or other structure between opposing sets of levers and arms associated with a folding lever assembly 8 and a guide arm assembly 10. Since the folding lever assembly 8 is the portion of the device 1 that is pressed through the hole in the ship's hull, the assembly is manually movable between a retracted position that enables it to fit through the hole and an extended position that prevents it from moving back through the hole under pressure of the inrushing water.

Figure 2:
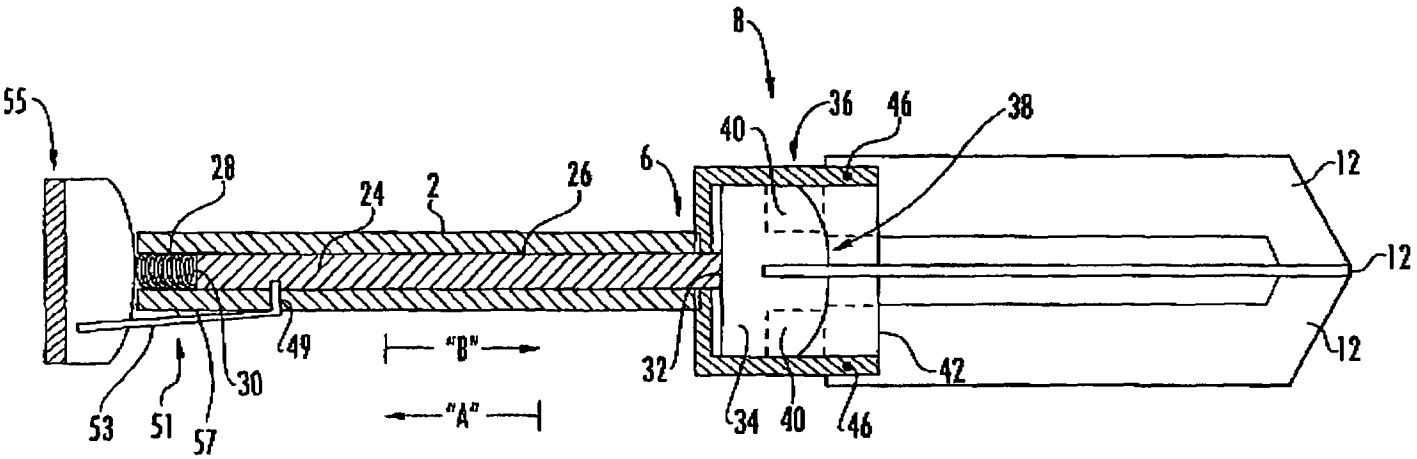
FIG. 2 is a cross-section view of a portion of the device of FIGS. 1A and 1B showing an exemplary activation mechanism for deploying the levers.

This actuation is accomplished by the use of a rod and piston arrangement, a portion of which is disposed within the shaft 2 and a portion of which is part of the folding lever assembly 8. As shown in FIG. 2, a rod 24 is disposed within a longitudinal blind bore 26 in the shaft 2. A spring 28 is positioned between the blind end of the bore 26 and a first end 30 of the rod 24 so that the spring is compressed by movement of the rod 24 in a first direction "A" within the bore 26. Conversely, expansion of the spring 28 causes the rod 24 to move in a second direction "B" within the bore 26.

A second end 32 of the rod 24 is connected to a piston 34. The piston 34 is slidable within a cylinder 36 fixed to the second end 6 of the shaft 2. The piston 34 has a dome shaped top surface 38 that is provided with a plurality of slots 40 disposed at 90-degree intervals about the piston. These slots follow the contour of the dome shape and extend down the sides of the piston to a depth of about 1 inch. Each of the slots 40 is associated with one of the plurality of extendable levers 12.

The cylinder 36 itself also has a dome-shaped top surface 42 with a plurality of slots 44 disposed at 90 degree intervals about the cylinder. Each of the slots 44 is associated with one of the plurality of extendable levers 12. The slots 44 radiate from the center of the cylinder 36 outward and extend down the sides of the cylinder by about 2 inches.

Figure 4A:
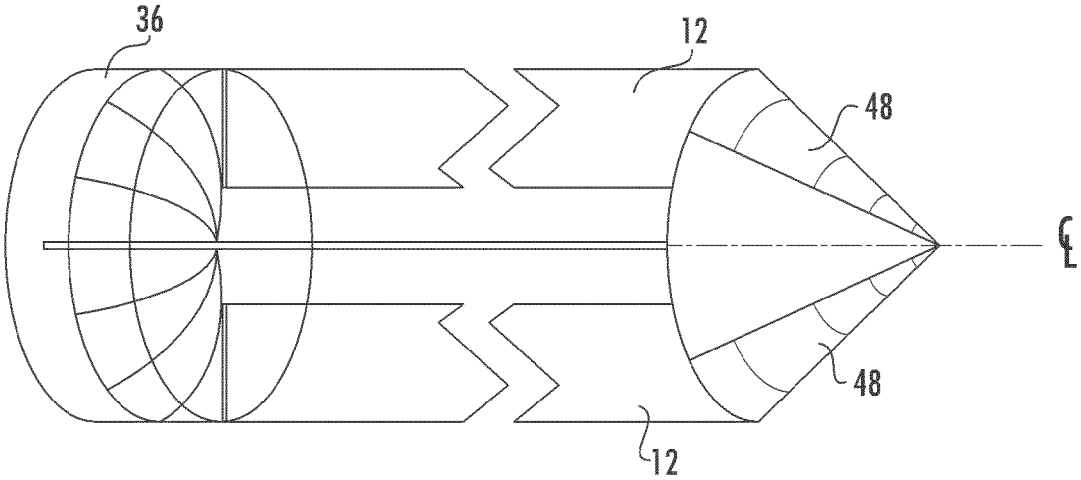
FIG. 4A is an isometric view of an end portion of the device of FIGS. 1A and 1B.
Figure 4B:
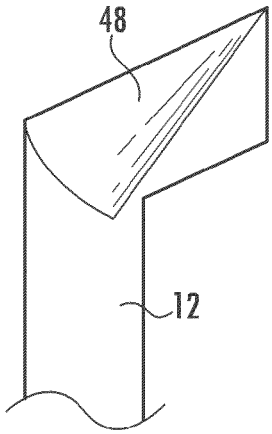
FIG. 4B is a detail view of an end segment of a lever portion of the device of FIGS. 1A and 1B.

The extendable levers 12 are connected to the cylinder 36 via respective pin joints 46 so as to be are movable between retracted and extended positions. Referring to FIGS. 4A and 4B, each lever 12 at its tip 48 curves back toward the centerline of the device 1 to form a bullet-shape when the folding lever assembly 8 is in the retracted position. Forming the tip 48 in such a streamlined shape facilitates insertion of the device into the hole since it reduces resistance to the device caused by the inrush of water through the hole 18.

It will be appreciated that although the illustrated embodiment has four levers 12 and a like number of slots 40, 44, this number is not critical, and greater or fewer numbers of levers/slots can be used as desired to suit a particular application.

Figure 5A:
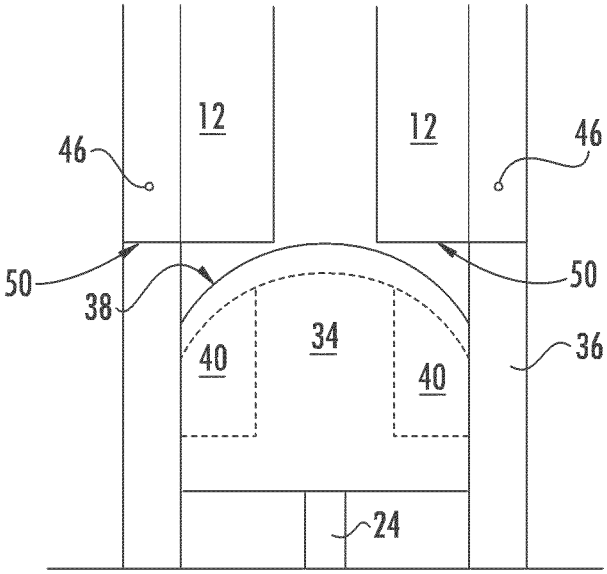
FIGS. 5A-5D are plan views showing the position of the piston and levers of the device of FIGS. 1A and 1B in various phases of actuation of the device.
Figure 5B:
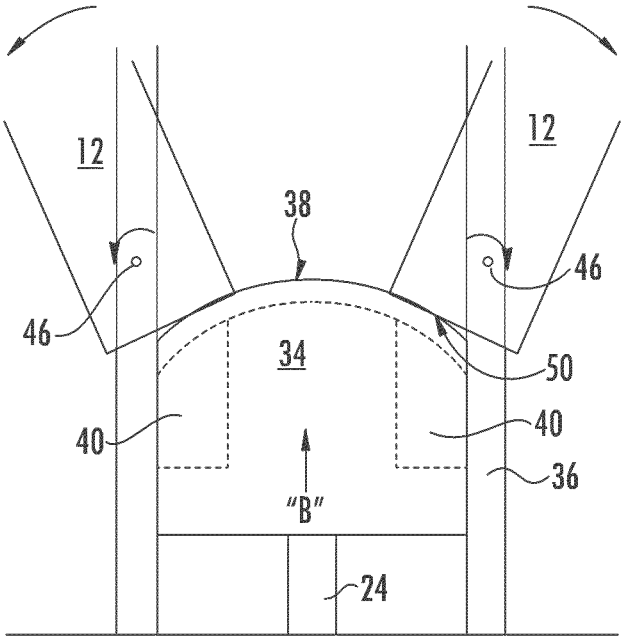
Figure 5C:
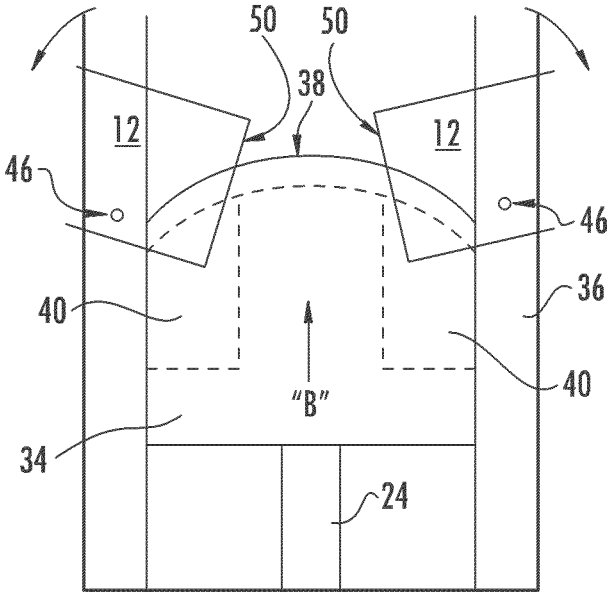
Figure 5D:
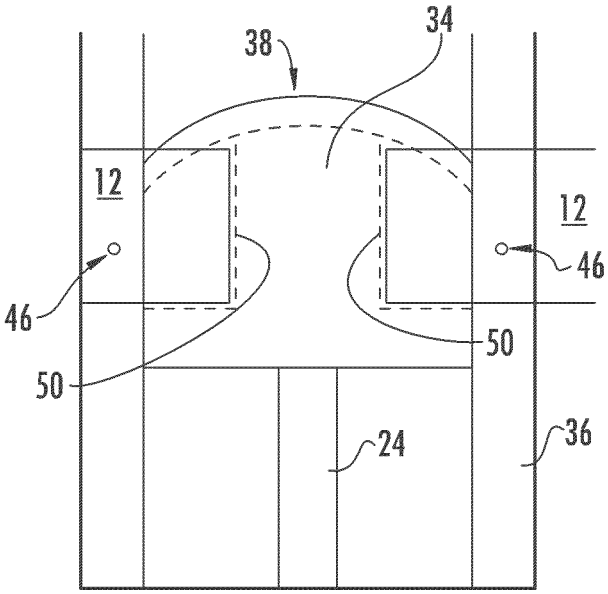

The extendable levers 12 are actuated from the retracted position to the extended position via interaction with the dome shaped top surface 38 and slots 40 of the piston 34. Referring to FIG. 5A, the extendable lever assembly 8 is shown in the retracted position. The top surface 38 of the piston 34 is positioned directly adjacent the flat bottom surfaces 50 of the levers 12. In FIG. 5B, the piston 34 is moved along the direction of arrow "B" by movement of the attached rod 24, which is forced in this direction by action of the spring 28 as it expands from its compressed condition. As can be seen, the top surface 38 of the piston 24 engages the flat bottom surfaces 50 of the levers 12. Because the point of engagement between the piston and levers is offset from the axis of rotation of the pin joints 46, the levers 12 rotate outward about the pin joints 46. In FIG. 5C, the piston 34 continues its movement along the direction of arrow "B" causing the bottom surfaces 50 of the levers 12 begin to seat within the slots 40 in the piston 34. In FIG. 5D, the piston 34 movement is complete, and the levers 12 are fully extended and seated within the associated piston slots 40. Though not explicitly shown, the levers 12 are also seated within associated slots 44 in the cylinder 36. The levers 12 remain locked in this extended position as long as the piston 34 remains in the position shown in FIG. 5D.

As previously noted, a seal 16 is attached to the extendable levers 12 so that when they levers rotate out to extended position the seal is opened up to cover the hole 18 in the hull of the ship. As shown in FIGS. 3A and 3B, the seal 16 is pressed between the levers 12 and the outside surface 20 of the ship's hull, minimizing further ingress of water through the hole 18. In one embodiment, the seal 16 is made from an elastomeric sheet material, which in one non-limiting example is neoprene. The seal 16 can be coated with a lubricating material to ensure that it will not stick to itself when it is unfolded as the levers 12 extend. In one embodiment, the seal 16 is adhered to the extendable levers 12. Alternatively, mechanical attachments such as rivets, screws, and the like can also be used.

The entire extendable lever assembly 12 may be covered with a thin plastic cover (not shown) that is pre-scored to allow it to break apart easily. The cover serves two purposes: first, it protects the levers 12 and the seal 16 during storage, and second, it further facilitates insertion of the device into the hole in the ship's hull while water rushes in. The bullet shaped tips 48 of the levers 12 combined with the plastic cover are expected to cause the inrushing water to flow around the device, reducing the overall resistance caused by the water during device insertion.

Actuation of the rod 24 and piston 34 is accomplished using a triggering mechanism 51 that includes a triggering pin 49. As shown in FIG. 2, the triggering pin 49 extends through the shaft 2 and rod 24 (in a manner similar to safety pin 52) and prevents the rod from moving within the longitudinal bore 26. To actuate the device, the triggering mechanism 51 is actuated and the triggering pin 49 is withdrawn from the rod 24, allowing the rod 24 to move in direction "B" under the force of the compressed spring 28. Once the device has been fully actuated such that the levers 12 have been fully extended (FIG. 1B), reverse movement of the rod 24 and piston 34 can be prevented by reinserting the safety pin 52.

In one embodiment, the triggering mechanism 51 may include a lever 53 attached to the triggering pin 49 that enables the triggering pin 49 to be withdrawn from engagement with the rod 24 by actuating the lever 53. A first end of the lever 53 may be connected to the triggering pin 52, while a second end of the lever 53 may reside within a slot in the handle 55 of the device 1. The lever 53 may be pivotable about a pivot point 57 positioned between the triggering pin 52 and the handle 55. The handle 55 may be of any appropriate design, and in one embodiment it may be similar to a shovel D-handle. To actuate the triggering mechanism 51, the user simply presses the second end of the lever 53, moving it within the slot in the handle and causing the lever to pivot about the pivot point 57. The corresponding movement of the first end of the lever causes the attached triggering pin 52 to withdraw from its engagement with the rod 24, enabling the rod 24 to move within the bore 2 in the shaft 2.

Figure 6A:
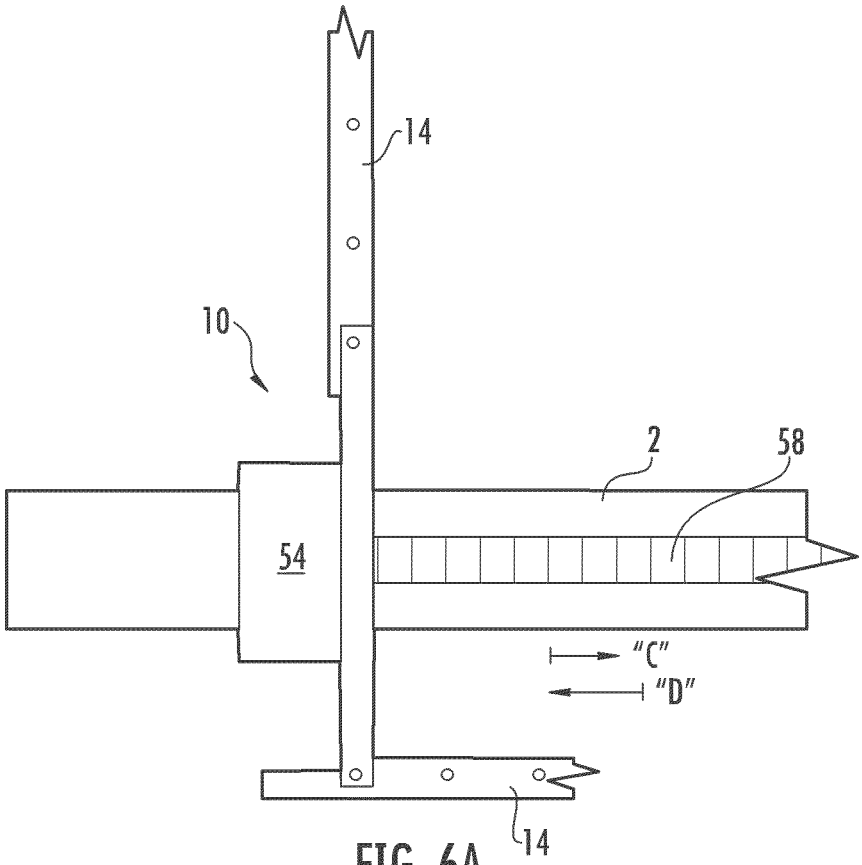
FIGS. 6A and 6B are detail views of the device of FIGS. 1A and 1B showing an exemplary guide arm arrangement including a ratchet and pawl control.
Figure 6B:
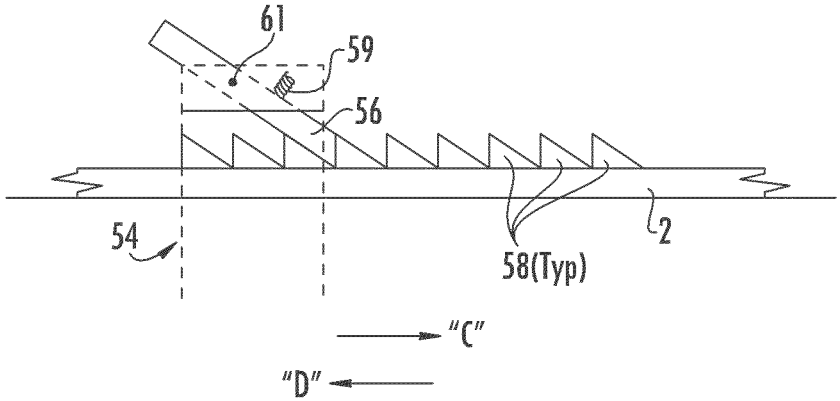

As previously noted, the guide arm assembly 10 is provided ensure that the device 1 remains in close contact with the ship's hull by sandwiching the hull between the guide arms 14 and the levers 12 (and seal 16). Referring to FIGS. 6A and 6B, the guide arm assembly 10 comprises a collar 54 that fits around the circumference of the shaft 2 so that it is slidable along the shaft. The collar 10 has a plurality of guide arms 14 connected thereto so that as the collar slides along the shaft, the guide arms 14 slide with it. Thus, when the extendable lever assembly 8 is configured in the extended position and engaged with the outside of the ship's hull, the guide arm assembly 10 is movable along the shaft (typically by hand) until the guide arms 14 engage the inside of the hull.

The collar 54 may include one or more pawls 56 configured to engage a plurality of ratchet teeth 58 formed in or on the surface of the shaft 2. The ratchet/pawl arrangement is such that the guide arm assembly 10 can be freely movable along the shaft 2 in the direction of the extendable lever assembly 12 (indicated by arrow "C") but can be restrained from reverse movement (direction indicated by arrow "D"). As the assembly 10 moves in direction "C" the pawl 56 slides up and over the ratchet teeth 58. The pawl 56 can be spring biased, forcing it down into engagement with the ratchet teeth 58 and preventing the assembly 10 from moving in the reverse direction.

In one embodiment, spring biasing is achieved by disposing a spring 59 in or on the collar 54 to press a first end of the pawl into engagement with the corresponding ratchet teeth 58. The pawl itself may be attached to the collar 54 by a pin connection. This pin connection 61 enables a user to disengage the pawl from the ratchet teeth by pressing down on a second end of the pawl. This pressing movement overcomes the spring force and lifts the pawl out of engagement with the teeth.

To operate the device 1, the user holds the device by the handle 55 and folds down and opens the guide arms 14 to the extended position (see FIG. 1B). The user may then pull out the safety pin 52 thus arming the device for use. Once the safety pin 52 is removed, the user holds the device 1 with one hand by the handle 55 and places his other hand on the shaft 2 beyond the guide arms 14. From this position the user may further manipulate the device, and with his hand holding the handle 55 he can thrust the device 1 into the hole 18 in the hull where the water is rushing in.

The user can thrust the device into the hole 18 until the guide arms 14 either make contact with the inner surface of the hull 22 (letting the operator know that the device will cover the hole in the hull) or until the guide arms 14 pass through the hole (letting the operator know that the hole is bigger than the device can efficiently cover). In the latter case, the guide arms 14 can be extended in the manner previously described) to allow the device 1 to cover the hole 18.

Once the device 1 is in position, the user pushes down on the lever 53 with his thumb. This raises the pin 52 out of the rod 24, enabling the spring 28 to expand, moving the rod 24 and the piston 34 toward the folding lever assembly 8. The piston 34 pushes the extendable levers 12, which fold out, along with the polymer cover, to cover the hole 18 in the hull. The levers and seal are held again the outside of the ship's hull by the force of the guide arms pushing against the inside of the hull, and the ratchet/pawl arrangement holds the guide arm assembly in place.

In the illustrated embodiments, the guide arms 14 are attached to the collar 10 at 90 degree intervals, equally spaced around the device's center line. As noted in relation to the folding levers 12, it will be appreciated that the number of guide arms 14 is not critical, and greater or fewer guide arms may be provided as desired.

As shown in the figures, the guide arms can be foldable to reduce the total amount of space required for the device. The guide arms 14 may be extendable by unfolding, or they may be axially extendible, or a combination of both so that the device is relatively compact in the stowed position.

Figure 7A:
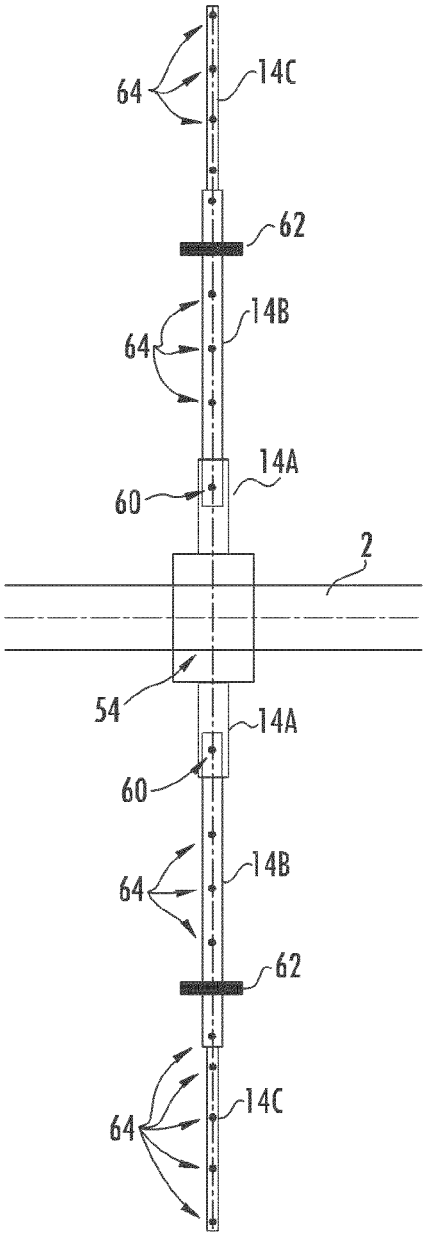
FIGS. 7A-7C are side views of the device of FIGS. 1A and 1B showing details of the guide arm assembly.
Figure 7B:
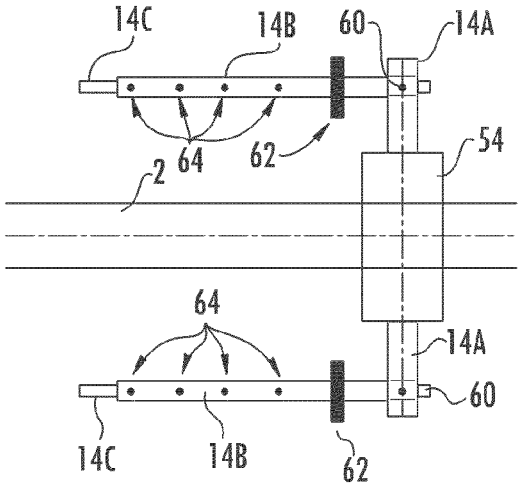
Figure 7C:
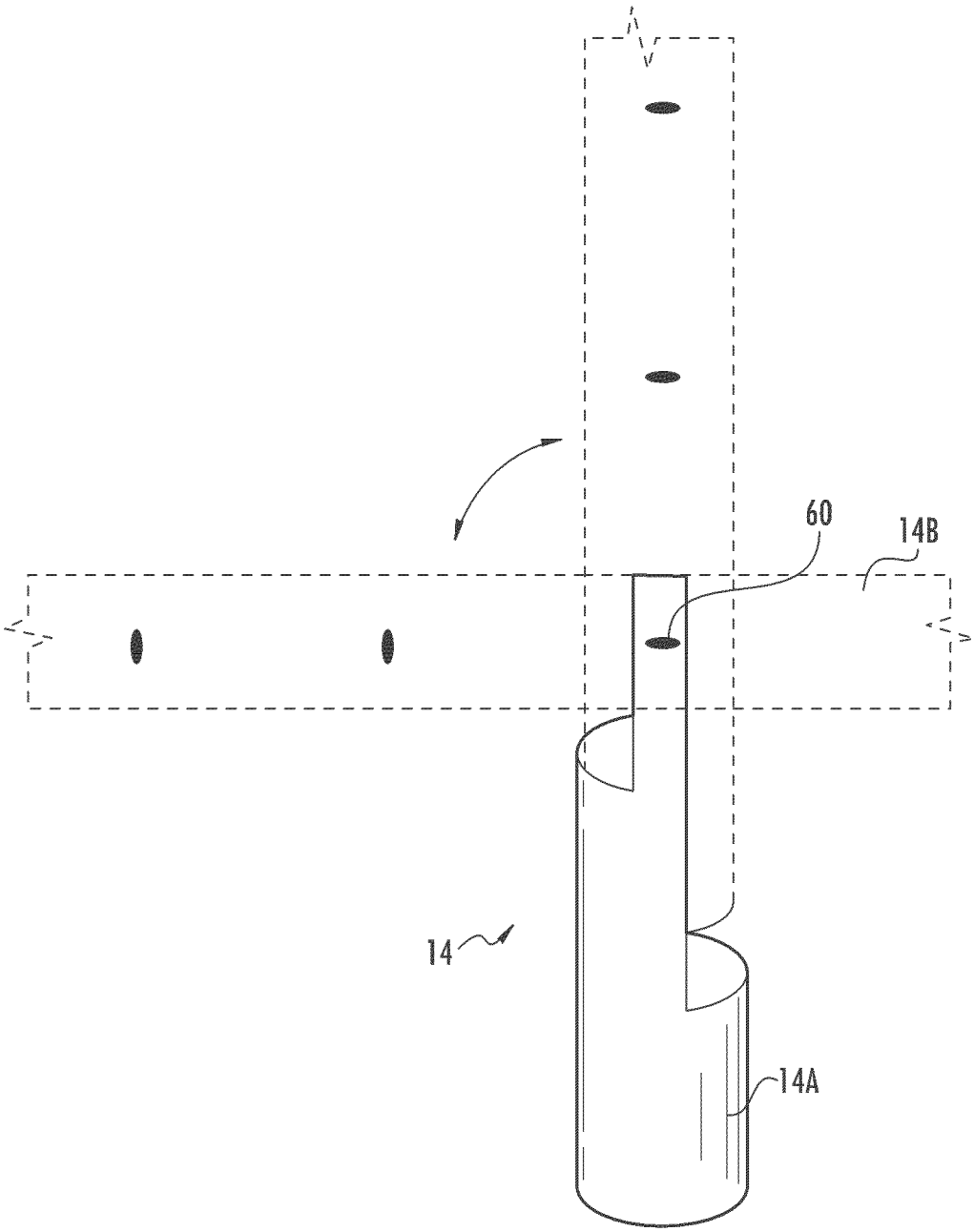

Referring to FIGS. 7A-7C, each guide arm 14 may comprise multiple arm segments 14A, 14B, 14C that can be adjusted with respect to each other to provide the guide arm with a desired length. The first segment 14A may be connected to the collar 54 of the guide arm assembly. The second segment 14B may be connected to the first segment via a pin joint 60 so that the second segment 14B can be pivoted (see FIG. 7C) between a stowed configuration (FIG. 7B) and a deployed configuration (FIG. 7A). The pin joint 60 may include a quick release pin to allow quick pivot adjustment of the first and second segments 14A, 14B with respect to each other. This quick release pin can also enable the second and third segments 14B, 14C of one or more of the guide arms 14 to be removed if they would interfere with the cinching of the device against the hull.

The third segment 14C may be telescopically associated with the second segment 14B so that in the stowed position at least a portion of the third segment 14C is received within the second segment 14B. A quick release pin 62 may be provided for each guide arm 14 to allow the third segment 14C to be adjusted with respect to the second segment 14B. A plurality of pin-receiving holes 64 may be provided in the second and third segments 14B, 14C to allow the guide arm 14 to be adjusted to a variety of desired lengths, depending upon the particular application.

As previously noted, The guide arms 14, once opened, may be used as a guide to inform the user about whether the device 1 will be able to completely cover the hole 18 in the hull. If the guide arms 14 can engage the inside of the hull, the device 1, when fully deployed, will cover the hole plus an area about six inches around the hole. It will be appreciated that the device can be manufactured in any of a variety of different sizes to cover different size holes. In one embodiment the device is sized to cover a hole in the hull having a diameter of about 12 inches, with an overlap of 6 inches all around the opening. For larger holes, two of the devices can be used side by side, although they may not be as strong as a single device because they will have to support each other at the point where they overlap.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A device for inhibiting fluid flow through an opening, comprising:

a shaft having first and second ends;

a folding lever assembly disposed at the second end of the shaft, the folding lever assembly having a retracted position and an extended position, the folding lever assembly further comprising:

a housing coupled to the second end of said shaft; and a plurality of levers, each said lever having a first lever end proximal to the second end of the shaft, and a second lever end distal to the second end of the shaft; each said lever pivotally connected to the housing at its first lever end, and wherein when the folding lever assembly is in the retracted position, each lever extends from the second end of the shaft in a direction away from the first end of the shaft;

a sliding guide arm assembly associated with the shaft, the sliding guide arm assembly having a plurality of guide arms; and a seal connected to the folding lever assembly;

wherein when the folding lever assembly is configured from the retracted position to the extended position the seal is configured from a folded configuration to an unfolded configuration and the folding lever assembly is positionable opposite the plurality of guide arms to enable the device to engage a structure therebetween.

2. The device of claim 1, wherein the sliding guide arm assembly further comprises a collar having a plurality of pawls for cooperatively engaging a plurality of ratchet teeth associated with the shaft such that the sliding guide arm assembly is freely movable in a first direction along the shaft but is restrained from moving in a second direction opposite the first direction.

3. The device of claim 1, further comprising:

a rod disposed in an axial bore in the shaft; and a piston connected to a first end of the rod;

wherein each said lever having its first lever end positioned adjacent to the piston;

wherein the rod is movable in a first direction to cause the piston to engage the first lever ends of the plurality of levers to thereby configure the folding lever assembly into the unfolded configuration.

4. The device of claim 3, further comprising a spring disposed within the bore, the spring engageable with a second end of the rod.

5. The device of claim 3, wherein the piston further comprises a plurality of slots associated with the plurality of levers, wherein when the folding lever assembly is configured in the unfolded configuration, the plurality of levers are locked within the plurality of slots to prevent further movement of the levers.

6. The device of claim 3, wherein the piston has a curved top surface for contacting the first ends of the plurality of levers.

7. The device of claim 6, wherein the housing comprises a cylinder for housing the piston, the cylinder having a plurality of cylinder slots for receiving the plurality of levers, wherein each of the plurality of levers is pivotally connected to the cylinder by a respective pin joint, the folding lever assembly configurable from the folded configuration to the unfolded configuration by rotation of the plurality of levers about the pin joints.

8. A device for covering an opening in a structure, comprising:

a shaft having first and second ends and a longitudinal axis;

a folding lever assembly disposed at the second end of the shaft, the folding lever assembly comprising: a housing fixed to the second end of the shaft; and a plurality of levers each pivotally connected to the housing at a first lever end, and extending therefrom to a second lever end, each of the plurality of levers having an extended position and a retracted position, each said first lever end positioned proximal to the shaft in relation to the second lever end, wherein when each of the plurality of levers is in the retracted position, each lever extends from the second end of the shaft in a direction away from the first end of the shaft;

a guide arm assembly having a collar slidably associated with the shaft such that the guide arm assembly is movable between first and second positions along the shaft; and a seal connected to at least one of the plurality of folding levers of the folding lever assembly;

wherein when the folding lever assembly is in the retracted position, the seal is in a folded configuration and the plurality of levers are oriented generally parallel to the longitudinal axis, and when the folding lever assembly is in the extended position, the seal is in an unfolded configuration.

9. The device of claim 8, wherein the collar comprises a plurality of pawls for cooperatively engaging a plurality of ratchet teeth associated with the shaft such that the guide arm assembly is freely movable in a first direction along the shaft but is restrained from moving in a second direction opposite the first direction.

10. The device of claim 8, further comprising:

a rod disposed in an axial bore in the shaft; and a piston connected to a first end of the rod;

wherein each of the plurality of levers has its first lever end positioned adjacent to the piston; and wherein the rod is movable in a first direction to cause the piston to engage the first lever ends of the plurality of levers to thereby configure the folding lever assembly into the extended position.

11. The device of claim 10, further comprising a spring disposed within the bore, the spring engageable with a second end of the rod.

12. The device of claim 10, the piston further comprising a plurality of slots associated with the plurality of levers, wherein when the folding lever assembly is configured in the extended configuration, the plurality of levers are locked within the plurality of slots to prevent further movement of the levers.

13. The device of claim 10, wherein the piston has a curved top surface for contacting the first ends of the plurality of levers.

14. The device of claim 13, wherein the housing comprises a cylinder for housing the piston, the cylinder having a plurality of cylinder slots for receiving the plurality of folding levers, wherein each of the plurality of levers is connected to the cylinder by a respective pin joint, the folding lever assembly configurable from the retracted configuration to the extended configuration by rotation of the plurality of folding levers about the pin joints.

15. A method for securing a device within an opening in a plate member, comprising:

providing a device having a shaft with fore and aft ends and a longitudinal axis, a plurality of arms each extending from the aft end of the shaft and pivotable via a pivot point disposed proximal the aft end of the shaft so as to be positionable in a retracted configuration wherein the arms extend generally parallel to the longitudinal axis from a point proximal to the aft end of the shaft away from the fore end of the shaft, and positionable in an extended configuration wherein the arms extend in a direction outwardly angularly divergent from the longitudinal axis, a plurality of guide arms movable along the shaft between the first and second ends, and a seal connected to at least one of the plurality of arms;

disposing the device in the retracted configuration within the opening such that the plurality of arms extending from the aft end of the shaft, and the pivot point, are positioned on a first side of the opening, and the plurality of guide arms are positioned on a second side of the opening; and actuating the device to cause the arms to pivot about said pivot point and extend in a direction outwardly angularly divergent from the longitudinal axis to the extended configuration; and moving the plurality of guide arms along the shaft to engage structure surrounding the opening to thereby sandwich the structure between the plurality of guide arms on the second side of the opening and the plurality of arms on the first side of the opening, wherein the extending arms in the extended configuration dispose the seal over the first side of the opening to inhibit fluid flow from the first side of the opening to the second side of the opening.

16. The method of claim 15, wherein the step of moving the plurality of arms to an extended configuration further comprises using a spring driven piston to force first ends of each of the plurality of arms to rotate about the individual pivot points.

17. The method of claim 16, further comprising locking the plurality of arms in the extended position by locking a position of the piston with respect to the shaft.

18. The method of claim 15, further comprising locking the plurality of guide arms in an axial position along the shaft via a ratchet and pawl arrangement.

19. A device for inhibiting fluid flow through an opening, comprising:

a shaft having first and second ends;

a folding lever assembly disposed at the second end of the shaft, the folding lever assembly having a retracted position and an extended position, the folding lever assembly further comprising:

a housing coupled to the second end of said shaft; and a plurality of levers, each said lever having a first lever end proximal to the second end of the shaft, and a second lever end distal to the second end of the shaft; each said lever pivotally connected to the housing at its first lever end, wherein when the folding lever assembly is in the retracted position, the second end of the shaft is disposed intermediate and in substantial longitudinal alignment with the first end of the shaft and the second lever end;

a sliding guide arm assembly associated with the shaft, the sliding guide arm assembly having a plurality of guide arms; and a seal connected to the folding lever assembly;

wherein when the folding lever assembly is configured from the retracted position to the extended position the seal is configured from a folded configuration to an unfolded configuration and the folding lever assembly is positionable opposite the plurality of guide arms to enable the device to engage a structure therebetween.

* * * * *